US010070674B1

(12) United States Patent
Beckers

(10) Patent No.: US 10,070,674 B1
(45) Date of Patent: Sep. 11, 2018

(54) HOOD APPARATUS

(71) Applicant: Brian Beckers, Rogersville, MO (US)

(72) Inventor: Brian Beckers, Rogersville, MO (US)

( * ) Notice: Subject to any disclaimer, the term of this patent is extended or adjusted under 35 U.S.C. 154(b) by 31 days.

(21) Appl. No.: 15/471,379

(22) Filed: Mar. 28, 2017

Related U.S. Application Data

(60) Provisional application No. 62/313,941, filed on Mar. 28, 2016.

(51) Int. Cl.
*A41D 27/00* (2006.01)
*A41D 1/04* (2006.01)

(52) U.S. Cl.
CPC ..... *A41D 27/00* (2013.01); *A41D 1/04* (2013.01); *A41D 2200/20* (2013.01); *A41D 2300/33* (2013.01)

(58) Field of Classification Search
CPC ..... A41D 2200/20; A42B 1/046; A42B 1/041
See application file for complete search history.

(56) References Cited

U.S. PATENT DOCUMENTS

| | | | | |
|---|---|---|---|---|
| 3,203,003 | A | 8/1965 | Plastino | 2/422 |
| D274,537 | S | 7/1984 | Wolens et al. | D21/59 |
| D283,233 | S | 4/1986 | Horwitz | D21/59 |
| 5,161,719 | A | 11/1992 | Otteson et al. | 223/24 |
| 5,615,416 | A * | 4/1997 | Haddad | A41D 3/00 2/171 |
| 6,088,838 | A * | 7/2000 | Sontag | A42B 1/046 2/202 |
| 6,370,692 | B1 | 4/2002 | Duyn et al. | 2/86 |
| 6,374,418 | B1 | 4/2002 | Rindle | 2/202 |
| 6,654,963 | B2 | 12/2003 | Fayle et al. | 2/84 |
| 7,380,286 | B1 | 6/2008 | Bryant, Sr. | 2/84 |
| 8,156,573 | B2 | 4/2012 | Gandy | 2/84 |
| 8,209,822 | B2 | 7/2012 | Okot | 24/115 |
| 8,756,713 | B2 | 6/2014 | Fu | 2/84 |
| 2005/0108804 | A1 | 5/2005 | Bush | 2/84 |
| 2007/0118960 | A1 | 5/2007 | Goodwin | 2/84 |
| 2007/0214614 | A1* | 9/2007 | Okot | A44B 19/262 24/432 |
| 2010/0043117 | A1 | 2/2010 | Hildebrandt | 2/84 |
| 2010/0306898 | A1 | 12/2010 | Aurum | 2/84 |
| 2011/0131704 | A1* | 6/2011 | Hughes | A42B 1/048 2/204 |
| 2011/0179548 | A1 | 7/2011 | Weston | 2/84 |
| 2014/0143931 | A1 | 5/2014 | Velasco | 2/84 |
| 2014/0317829 | A1 | 10/2014 | Rolfe | 2/84 |
| 2018/0007995 | A1* | 1/2018 | Morales | A42B 7/00 |

* cited by examiner

*Primary Examiner* — Tejash Patel
(74) *Attorney, Agent, or Firm* — Jonathan A. Bay

(57) ABSTRACT

The invention relates to fancy goods for hooded wearing apparel and, more particularly, to a spring or expanding band for alternatively holding or clenching the opening of a hood of hooded wearing apparel to a set shape.

12 Claims, 9 Drawing Sheets

HOOD APPARATUS

CROSS-REFERENCE TO PROVISIONAL APPLICATION(S)

This application claims the benefit of U.S. Provisional Application No. 62/313,941, filed Mar. 28, 2017. The foregoing patent disclosure is incorporated herein by this reference thereto.

BACKGROUND AND SUMMARY OF THE INVENTION

The invention relates to fancy goods for hooded wearing apparel and, more particularly, to a spring or expanding band for alternatively holding or clenching the opening of a hood of hooded wearing apparel to a set shape.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
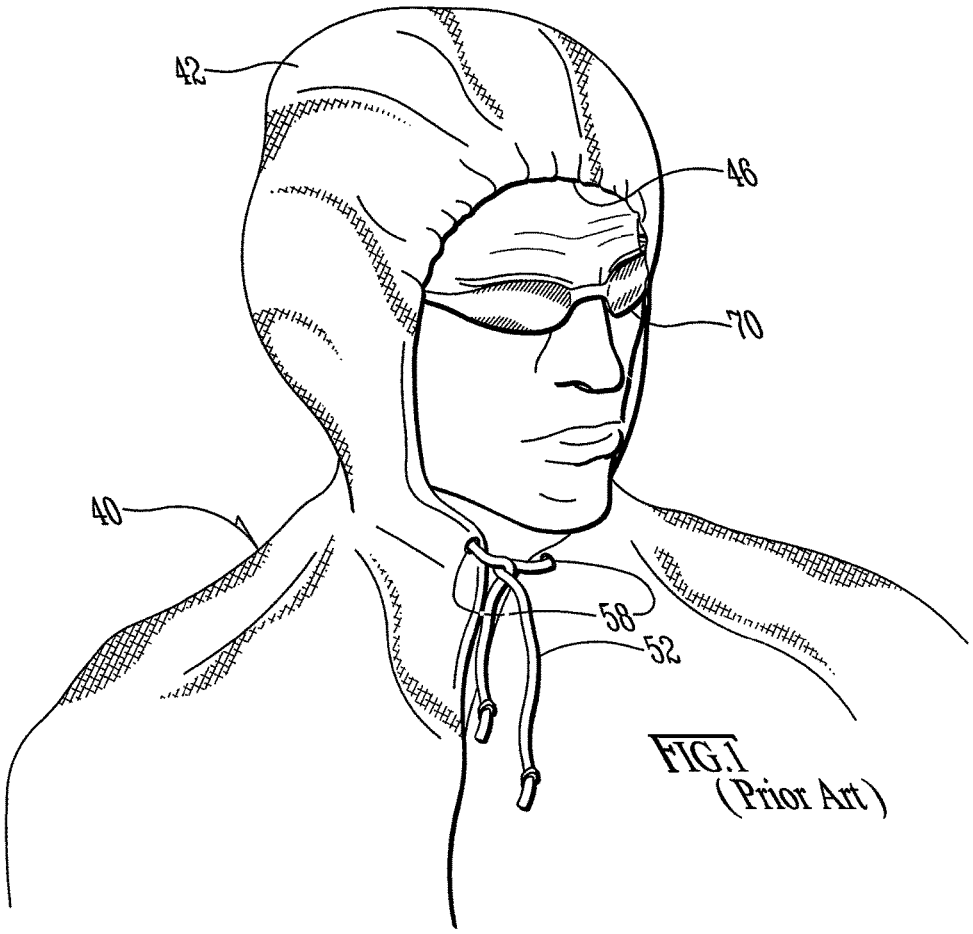
FIG.1 (Prior Art)
FIG. 1 is a perspective view of the prior art and comparable to FIGS. 2A and 3A except showing a hooded sweatshirt (eg., hooded wearing apparel) without a hood band in accordance with the invention, and with the wearer wearing sunglasses (or eyeglasses) and having cinched the drawstring tight to tighten the hood around the wearer's face.

FIGS. 2A through 10 show a hood band 20 in accordance with the invention, wherein a hooded sweatshirt (eg., hooded wearing apparel 40) is shown outfitted with the inventive hood band 20 (albeit shown in hidden lines in FIGS. 2A-3B and 10) to show a preferred manner of use.

Preferably the inventive hood band 20 comprises an inverted-U shaped hoop of spring material. The inverted-U shaped has a central web portion 22 that transitions into a pair of flanking legs 24 which terminate in opposite feet 26 that are slightly splayed out. The central web portion 22 and legs 24 trace a smooth open-ended ovate curve, with the open end being at the bottom of the curve. Again, the feet 26 serve as little tab ends (eg., feet 26) that are slightly splayed out so as not to poke the wearer uncomfortably in the face or neck by the very tip ends 28 thereof. Spring steel is preferred without exclusion over other metal or non-metallic materials. More preferential still is spring steel formed from flat strip material.

Such flat strip material is indefinitely long between opposite ends and has two broad surfaces 32 and 34 spaced by two thin surfaces 36. The inverted-U shape is formed in the two thin surfaces 36. One broad face 32 will be an inner surface 32 as the other broad surface 34 will be that outer surface 34. By forming the inventive hood band 20 this way out of flat strip material, the inverted-U shape of the inventive hood band 20 will be better able to retain its shape in one plane.

That is, the web 22 and legs 24 of the inventive hood band 20 can be flexed to (or permanently bent into) a more widespread U-shape (or more narrow U-shape), but preferably the legs 24 remain co-planar with another. In other words, preferably the legs 24 do not form a part of a coil of a helix. The hood band 20 in accordance with the invention is typically custom fit by the wearer thereof by bending the hood band 20 on a more or less permanent basis to a chosen width or narrowness, according the comfort or likes of the wearer. Ideally, after the hood band 20 is bent wider or narrower, and then laid on a flat table or desk top, it is an aspect of the invention that the hood band 20 should lay flat.

Hooded wearing apparel 40 typically have a hood 42 that is formed with a front seam or hem 44 that defines the opening 46 for the hood 42. One function served by the front seam or hem 44 serves is to form a fold of fabric sewn back on itself so the fabric does not fray. The front seam or hem 44 typically may also serve a secondary purpose, which is that as serving to define a drawstring channel 48 that is furnished with a drawstring 52. The drawstring channel 48 has an inverted-U shape having a brow portion 54 that transitions into flanking cheek portions 56 that terminate in a spaced pair of left and right openings 58 (typically located under the wearer's chin, over the wearer's left and right collar bones). The openings 58 might be reinforced by grommets 62 or not, additional close-knit stitching or not, and so on.

A drawstring 52 is threaded into an opening 58 on one side of the drawstring channel 48 therefor, threaded all the way though the drawstring channel 48 and out the opening 58 on the other side.

FIGS. 7-10 show that, in nearly the same manner, the hood band 20 in accordance with the invention is threaded into an opening 58 on one side of the drawstring channel 48, and threaded though the drawstring channel 48—but—not so far as to come out the opening 58 on the other side of the drawstring channel 48.

It is an aspect of the invention that the inventive hood band 20 is inserted inside the drawstring channel 48, to reside more or less permanently in there, without either end of the inventive hood band 20 protruding from out either opening 58 of the drawstring channel 48.

Although made of spring material, the inventive hood band 20 is sized to provide a gentle squeeze on the wearer's brow and cheeks. That way, the inventive hood band 20 develops a relative amount of rigidity (relative that is, to fabric).

Moreover, the inventive hood band 20 holds the opening 46 of the hood 42 of hooded wearing apparel 40 to a (more or less) set shape.

FIG. 1 shows the prior art way of cinching down the hood 42 of a hooded sweatshirt (eg., hooded wearing apparel 40) without a hood band 20 in accordance with the invention. Actually, hoods 42 can be cinched down far tighter than shown, as something like shown by the hood-wearing style of the cartoon character KENNY® on the cartoon show SOUTH PARK®. That is, the wearer can only see out through a tunnel created by the hood 42. However, FIG. 1 is believed to more realistically depict the hood wearing fashion in accordance with the prior art of an outdoor worker (eg., a construction worker) wearing hooded wearing apparel 40 for warmth while wearing sunglasses 70 too for combating harsh and bright winter glare (or just more simply eyewear 70, or, eyeglasses 70:—as for vision correction).

A problem in accordance with the prior art that wearing sunglasses 70 (eg., eyewear 70) under a hood 42 cinched as tight as shown in FIG. 1 comprises the following:—every time the wearing turns his or her head to the left or right, a corner of the eyewear 70 on the inside of the turning head might get slightly covered, and/or, the eyewear 70 get pushed about and knocked off kilter. The wearer's clarity of vision is slightly impaired during the time that wearer has his or her head twisted. It is better to twist the whole upper body rather than the head alone to keep the eyewear 70 wearing straight, but this is unnatural to do, and sometimes not possible to do when undertaking outdoor work.

Figure 2A:
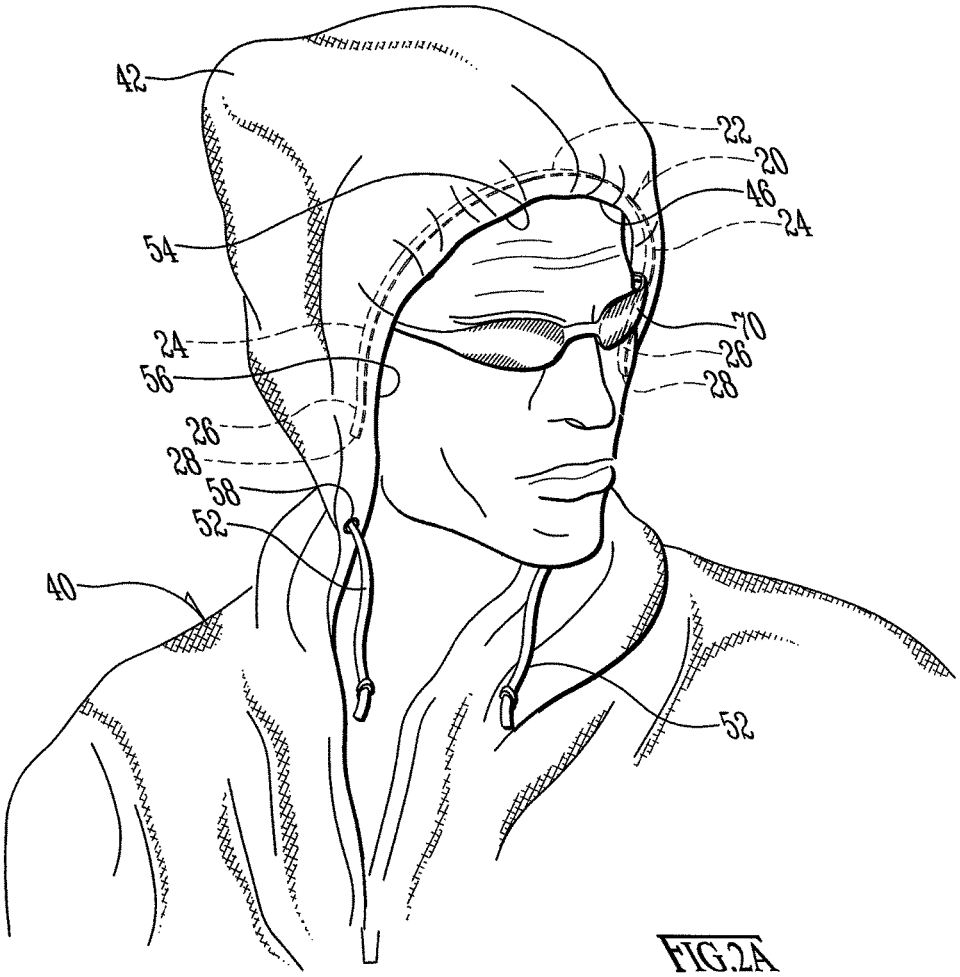
FIG. 2A is a perspective view of a hood band in accordance with the invention, wherein the hooded sweatshirt (eg., hooded wearing apparel) is shown outfitted with the inventive hood band (albeit the inventive hood band is shown in hidden lines) to show a preferred manner of use.
Figure 2B:
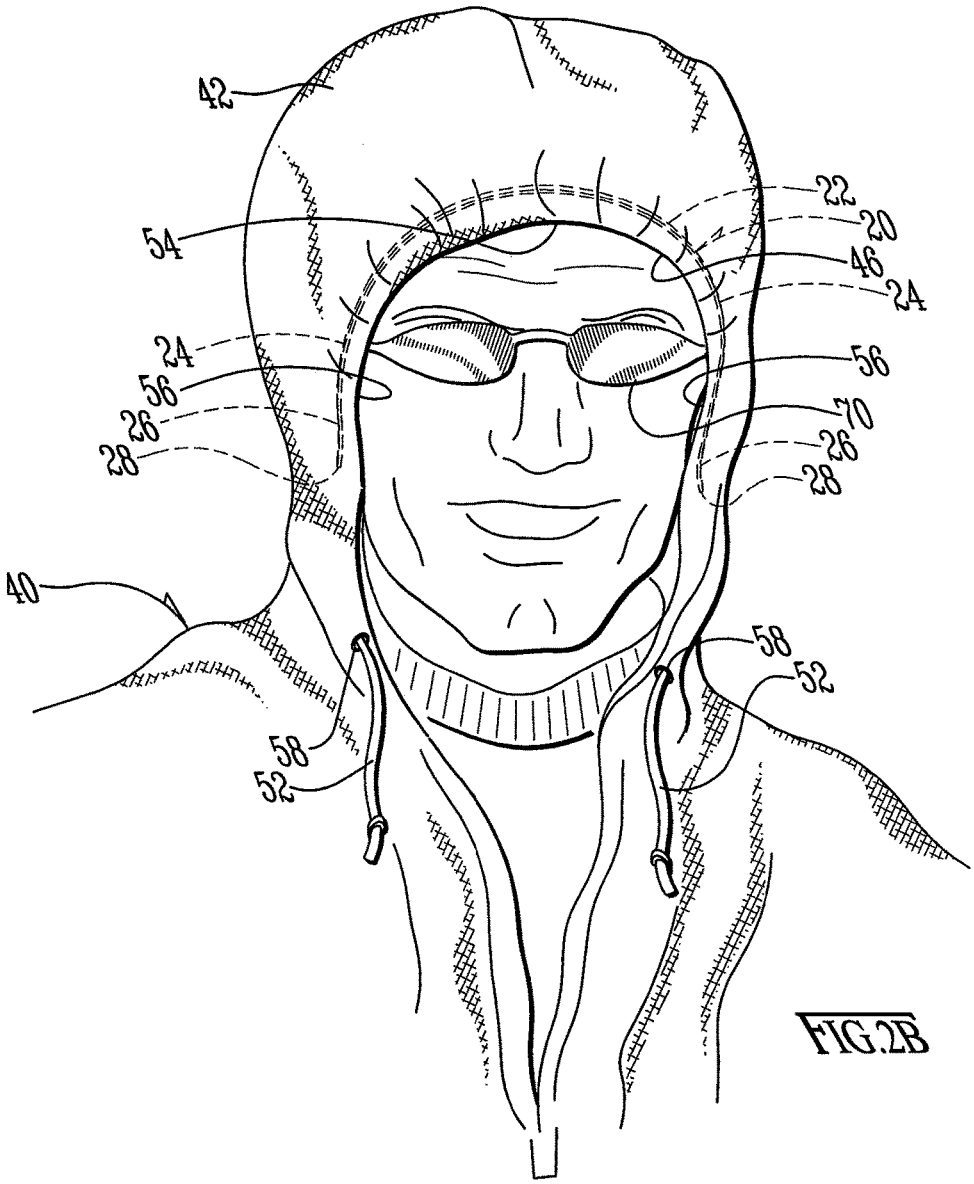
FIG. 2B is a front elevation view of FIG. 2A.

FIG. 2A shows a wearer wearing the hooded wearing apparel 40 (ie., a hooded sweatshirt) that is shown in FIG. 1 except here the hooded wearing apparel 40 is outfitted with the hood band 20 in accordance with the invention.

Figure 3A:
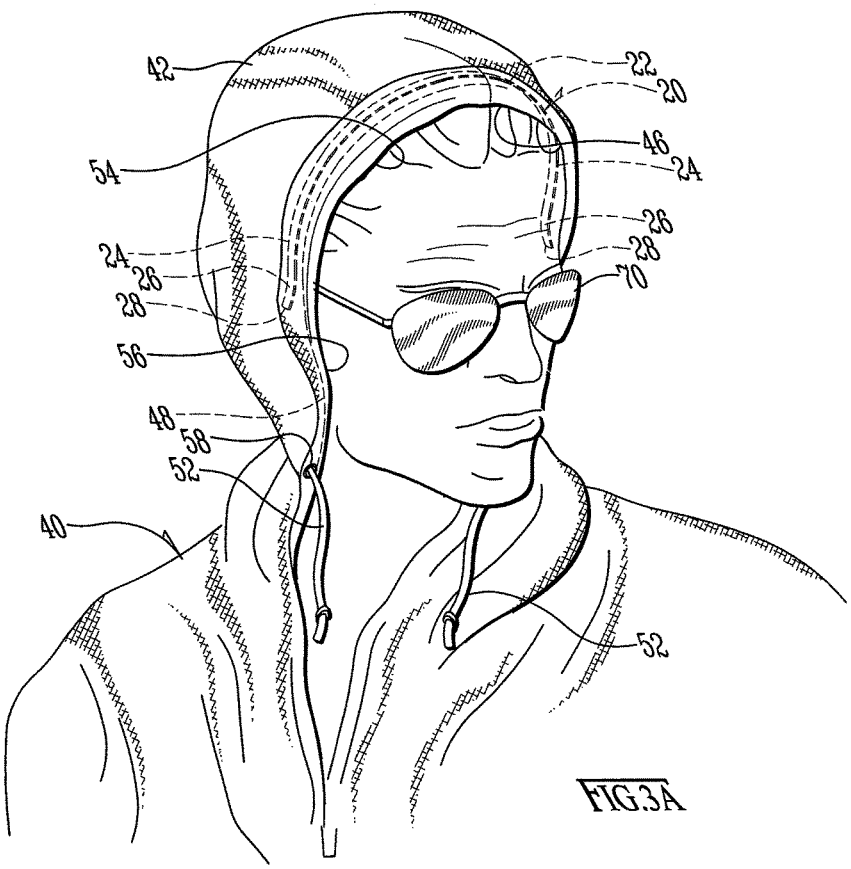
FIG. 3A is a perspective view comparable to FIG. 2A except the hood band is lifted, with the seam or hem forming the drawstring channel of the hood rolled underneath the hood band to overlap a layer of the hood, and for the purpose of improving peripheral visibility.

FIG. 3A is a perspective view comparable to FIG. 2A except wherein:— the hood band 20 is lifted; and the drawstring channel 48 (defined by seam or hem 44) of the hood 42 is rolled underneath the hood band 20 to overlap a layer of the hood 42;

for the purpose of peeling back the opening 46 of the hood 42, and thereby make it bigger and fitting farther back on the wearer's forehead and face, so as to improve not only non-interference between the hood 42 and eyewear 70 when the wearer turns his or her head but also with peripheral visibility.

Figure 3B:
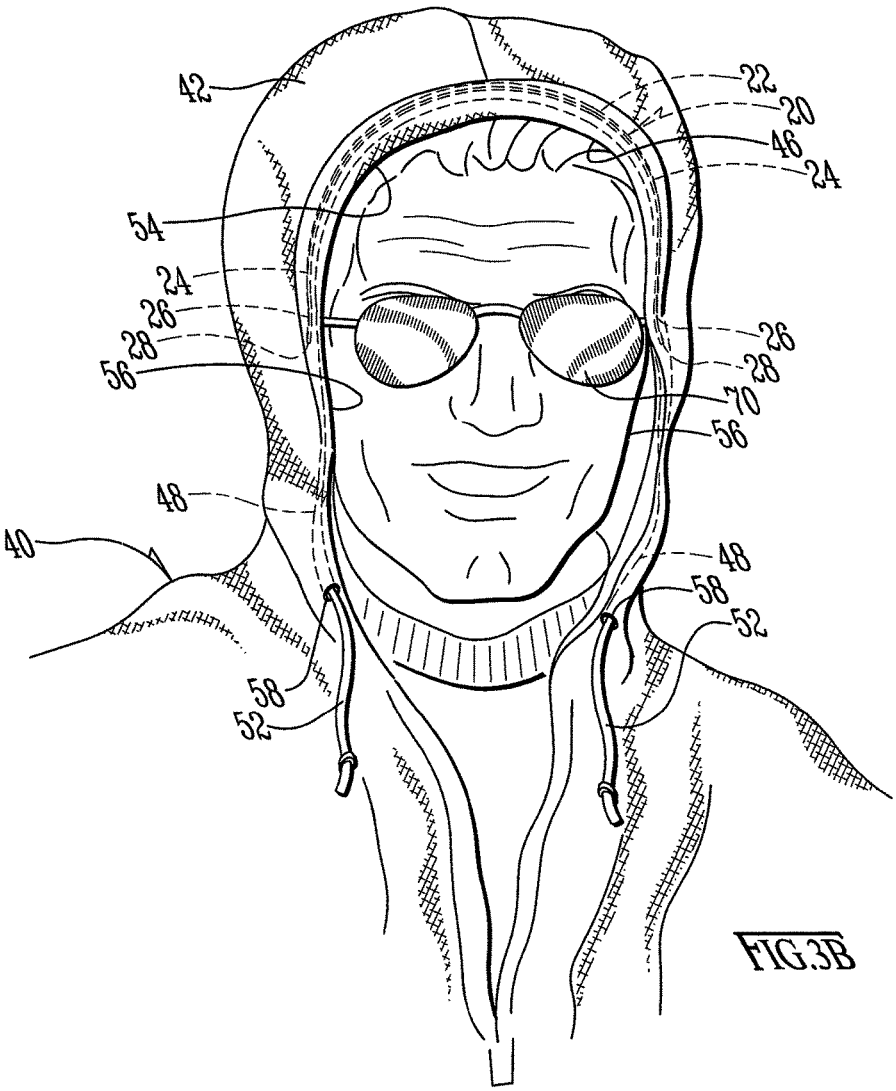
FIG. 3B is a front elevation view of FIG. 3A.
Figure 4:
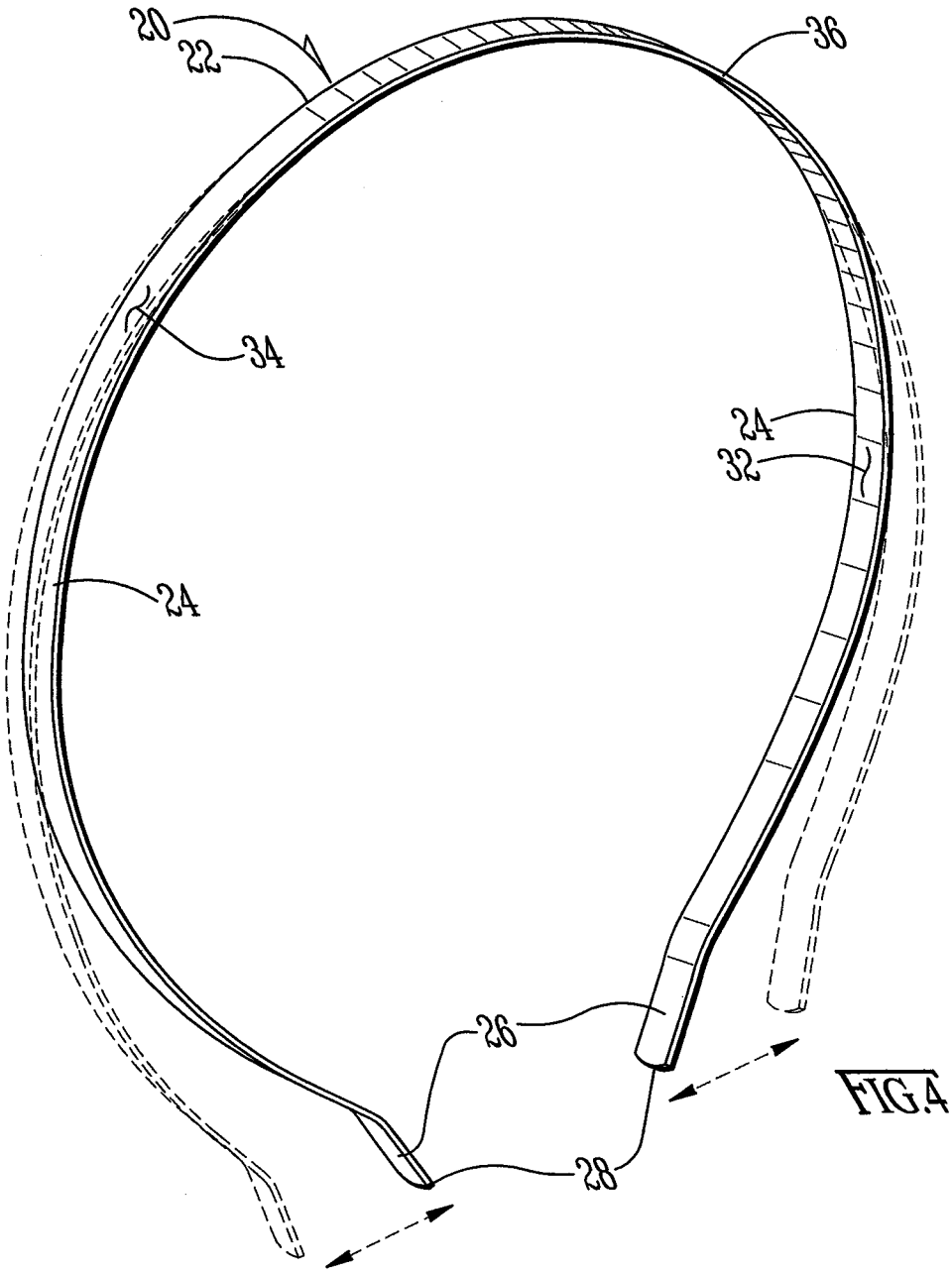
FIG. 4 is an enlarged scale perspective view of the hood band shown in isolation.
Figure 5:
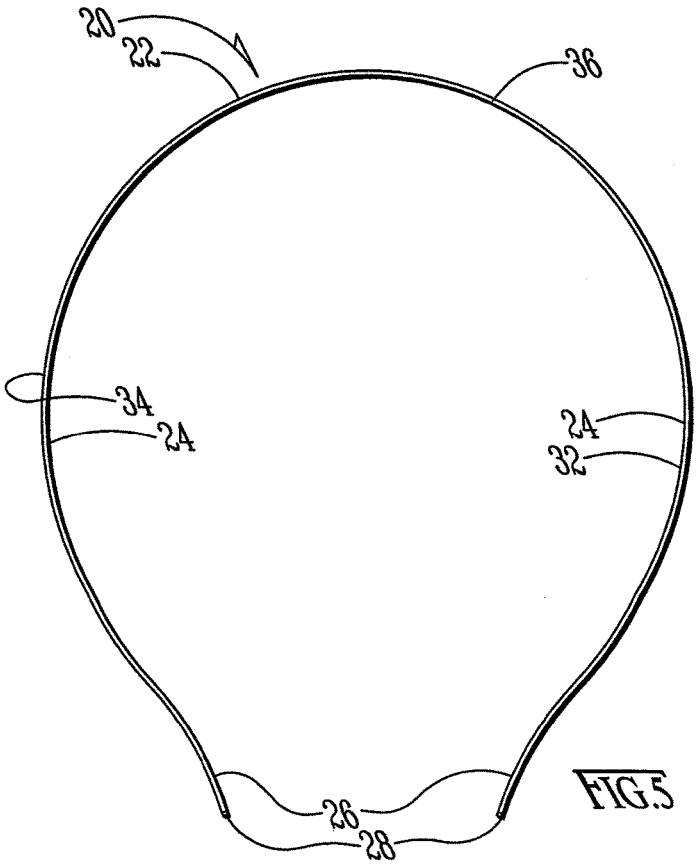
FIG. 5 is front elevational view thereof.
Figure 6:
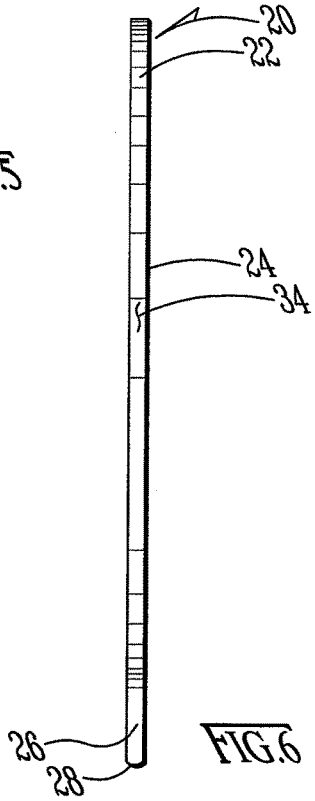
FIG. 6 is a side elevational view thereof.
Figure 7:
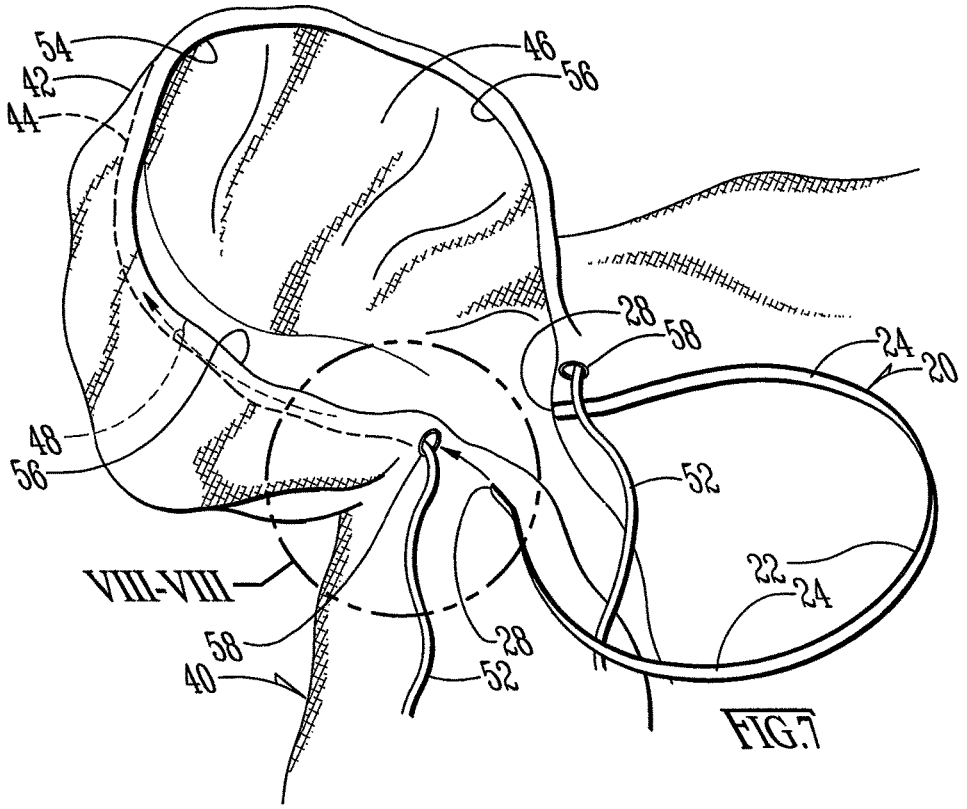
FIG. 7 is a reduced scale perspective view showing the preparation of threading inventive hood band into drawstring channel of the hood through one grommet of the drawstring channel.
Figure 8:
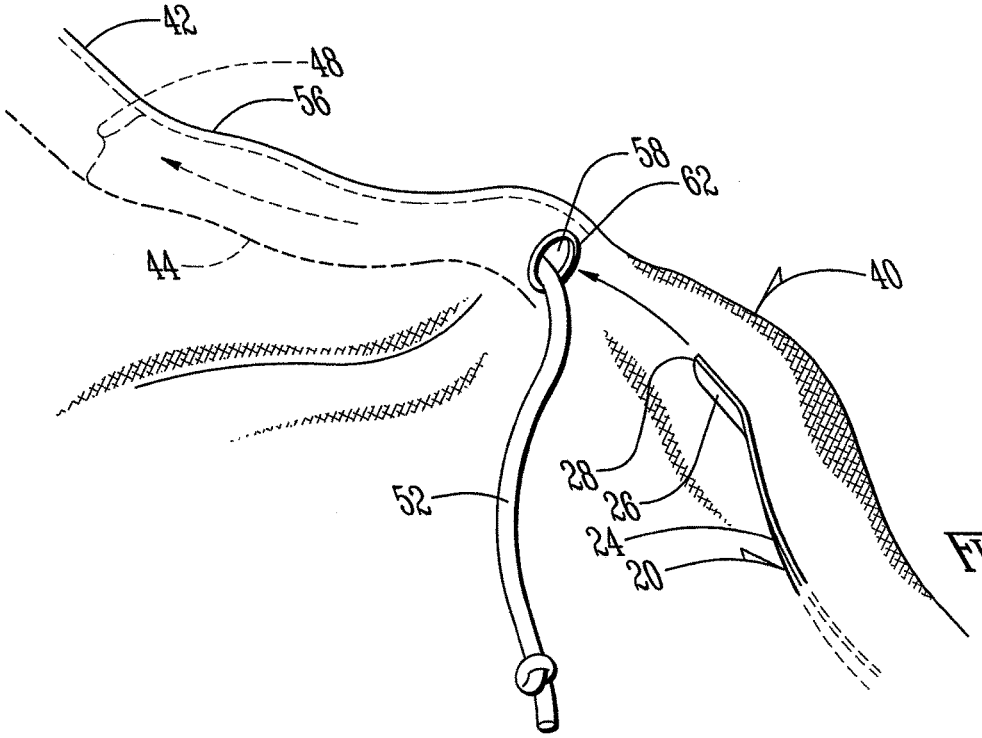
FIG. 8 is an enlarged scale perspective view of detail VIII-VIII in FIG. 7, showing the insertion of the inventive hood band through one grommet of the drawstring channel of the hood.
Figure 9:
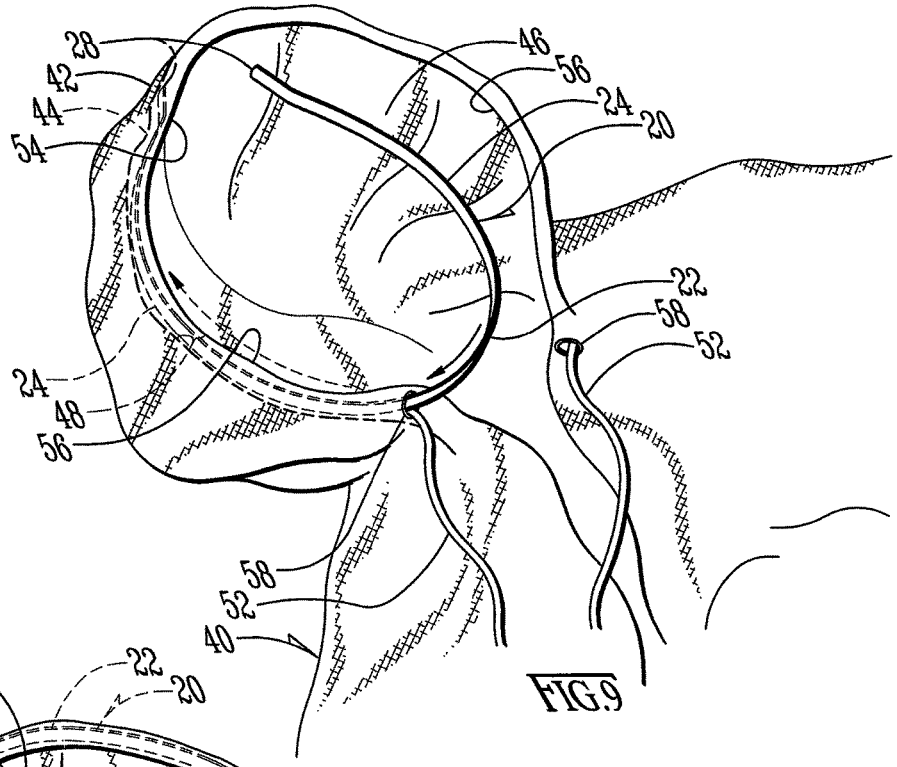
FIG. 9 is perspective view comparable to FIG. 7 except showing a partial state of completion of inserting the hood band into the drawstring channel of the hood.
Figure 10:
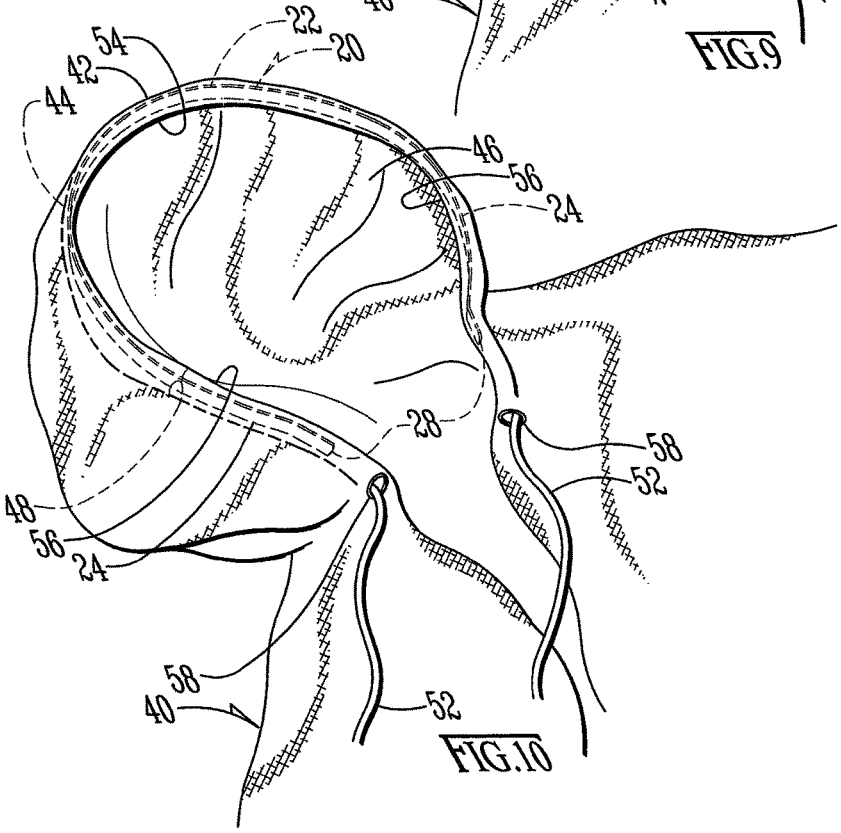
FIG. 10 is perspective view comparable to FIG. 9 except showing completion of insertion of the hood band into the drawstring channel of the hood.

FIG. 3B is comparable to FIG. 3A except from a vantage point showing the wearer from the front.

The drawstring channel 48 can be flipped backwards for a variety of reasons.

One, with the drawstring channel 48 flipped back the wearer has greater peripheral vision, rather than be forced to stare through a tunnel.

Second, the fit is closer between the hood band 20 portion of the hood 42 and the top (and wider part) of the wearer's head. That is, the hood band 20 is flexed wider in the drawstring channel 48 of the hood 42 and thus provides a tighter seal against wind from blowing into the hood 42.

Third, hood band 20 prevents the hood 42 with interfering with eyewear. That is, the wearer can comfortably wear eyewear 70 (eg., sunglasses) and turn his or head without the hood 42 knocking the eyewear off kilter.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A combination comprising:

hooded wearing apparel; and a hood band;

wherein the hooded wearing apparel comprises a hood having a front seam or hem defining:— a hood opening for the hood, and a brow portion and cheek portions for the hood opening, and wherein the hood band is resilient and is associated with the brow and cheek portions of the hood opening;

wherein the hood opening further comprises a channel arcing around the brow and cheek portions;

said channel comprising at least one channel opening;

said hood band is threaded into the channel by way of the at least one channel opening;

said channel is formed by a seam or hem of fabric about the hood opening; and said channel comprises a drawstring channel terminating in not just one channel opening but a pair of spaced drawstring channel openings.

2. A combination comprising:

hooded wearing apparel; and a hood band;

wherein the hooded wearing apparel comprises a hood having a front seam or hem defining:— a hood opening for the hood, and a brow portion and cheek portions for the hood opening, and wherein the hood band is resilient and is associated with the brow and cheek portions of the hood opening;

wherein the hood opening further comprises a channel arcing around the brow and cheek portions;

said channel comprising at least one channel opening; and said hood band is threaded into the channel by way of the at least one channel opening wherein the hood band comprises a band of spring material formed in an inverted U-shape terminating in opposed tip ends, and sized and configured for being able to be threaded into at least one channel opening channel by at least one tip end thereof for more or less permanent residence in the channel with inverted U-shape as well as being sized and configured to be counterpart to the brow and cheek portions of the hood opening.

3. The combination of claim 2, wherein:

the hood can be worn wherein the hood band is lifted, with the channel containing the hood band for the hood rolled underneath the hood band to overlap a layer of the hood, and for the purpose of improving peripheral visibility.

4. The combination of claim 3, wherein:

the hood band comprises a band of spring steel.

5. The combination of claim 2, wherein:

the hood band comprises a band of flat strip material is indefinitely long between opposite ends and has two broad surfaces spaced by two thin surfaces;

said inverted-U shape being is formed in the two thin surfaces such that one broad face will be an inner surface as the other broad surface will be that outer surface;

whereby forming the hood band this way out of flat strip material, the inverted-U shape of the hood band will be better able to retain its shape in one plane.

6. The combination of claim 5, wherein:

the hood can be worn wherein the hood band is lifted, with the channel containing the hood band for the hood rolled underneath the hood band to overlap a layer of the hood, and for the purpose of improving peripheral visibility.

7. The combination of claim 6, wherein:

the hood band comprises a band of spring steel.

8. A combination comprising:

hooded wearing apparel; and a hood band;

wherein the hooded wearing apparel comprises a hood having a front seam or hem defining:— a hood opening for the hood, and a brow portion and cheek portions for the hood opening, and wherein the hood band is resilient and is associated with the brow and cheek portions of the hood opening; and wherein the hood band comprises a band of spring material formed in an inverted U-shape terminating in opposed tip ends, and sized and configured to be counterpart to the brow and cheek portions of the hood opening.

9. The combination of claim 8, wherein:

the hood band comprises a band of spring steel.

10. The combination of claim 8, wherein:

the hood band comprises a band of flat strip material is indefinitely long between opposite ends and has two broad surfaces spaced by two thin surfaces;

said inverted-U shape being is formed in the two thin surfaces such that one broad face will be an inner surface as the other broad surface will be that outer surface;

whereby forming the hood band this way out of flat strip material, the inverted-U shape of the hood band will be better able to retain its shape in one plane.

11. The combination of claim 10, wherein:

the hood band comprises a band of spring steel.

12. The combination of claim 11, wherein:

the hood band has proximate its opposite ends abbreviated splayed out tabs.

* * * * *